US007017832B1

(12) United States Patent
Nelson et al.

(10) Patent No.: US 7,017,832 B1
(45) Date of Patent: Mar. 28, 2006

(54) PIERCING HOSE NOZZLE

(75) Inventors: Wesley Nelson, Billings, MT (US); Frank Michaud, Billings, MT (US)

(73) Assignee: Pro-Fab, Inc., Billings, MT (US)

( * ) Notice: Subject to any disclaimer, the term of this patent is extended or adjusted under 35 U.S.C. 154(b) by 0 days.

(21) Appl. No.: 10/828,634

(22) Filed: Apr. 21, 2004

Related U.S. Application Data

(60) Provisional application No. 60/465,493, filed on Apr. 23, 2003.

(51) Int. Cl.
*A62C 7/02* (2006.01)
*B05B 9/01* (2006.01)

(52) U.S. Cl. ..... 239/271; 239/567; 239/525; 169/70

(58) Field of Classification Search ..... 239/271, 239/567, 276, 525, 530, 531, 556, 557; 169/70, 169/54
See application file for complete search history.

(56) References Cited

U.S. PATENT DOCUMENTS 2,548,621 A * 4/1951 Rutledge ..... 239/271
2,993,650 A * 7/1961 Badberg ..... 239/271
4,147,216 A * 4/1979 Schnepfe et al. ..... 169/70
4,219,084 A * 8/1980 Gray et al. ..... 119/70
4,697,740 A * 10/1987 Ivy ..... 239/271
4,802,535 A * 2/1989 Bakke ..... 169/70
4,882,956 A * 11/1989 Lang ..... 81/20
5,062,486 A * 11/1991 McClenahan ..... 169/70
5,253,716 A * 10/1993 Mitchell ..... 169/70
5,301,756 A * 4/1994 Relyea et al. ..... 169/24
5,540,284 A * 7/1996 Esposito et al. ..... 169/62
5,649,599 A * 7/1997 Catanese, Jr. ..... 169/70
6,398,136 B1 * 6/2002 Smith ..... 239/600
2002/0179307 A1 * 12/2002 Schmidt et al. ..... 169/70

* cited by examiner

*Primary Examiner*—David A. Scherbel
*Assistant Examiner*—Darren Gorman
(74) *Attorney, Agent, or Firm*—Shane P. Coleman; Holland & Hart LLP

(57) ABSTRACT

A piercing nozzle is disclosed having first and second elongated, hollow members connected at a connection that allows fluid to be communicated from the first member to the second member. The first member has a hose connector for attachment to a hose. The second member has a plurality of holes positioned proximate an end that penetrates a wall. An anvil is connected to the second member proximate the first end of the second member, and a piercing tip is connected to the second end of the second member. In use, the nozzle may be swung like an axe to penetrate a wall. Water or other fluid passes through interior cavities of the nozzle from the second end of the first member, through the first and second members, and out the holes in the second member, on an opposing side of the wall.

30 Claims, 7 Drawing Sheets

PIERCING HOSE NOZZLE

PRIORITY CLAIM

This application claims the benefit of U.S. Provisional Patent Application No. 60/465,493, filed Apr. 23, 2003, which is hereby incorporated by reference.

FIELD OF INVENTION

The present invention relates generally to hose coupling devices. More particularly, it relates to a nozzle for a firefighting hose, having a sharpened tip.

BACKGROUND

In the field of firefighting, it is often necessary to extinguish a fire in an area that is closed off by walls or otherwise inaccessible. For example, access to a house fire may be blocked from the outside by the home's walls or roof, or access to a fire in an automobile engine or passenger compartment may be blocked by the hood or the car doors and roof. Conventional means for fighting these fires is to open the walls using an axe or similar tool to provide access to the fire and then to use a conventional fire hose to spray water through the opening. One problem with this method is that the opening in the wall allows an excessive amount of air to pass from an outer side of the wall to the inner side of the wall, where the fire is burning. This air fans the flames in many cases and causes the fire to burn even more rapidly until the fire is extinguished.

SUMMARY

A piercing nozzle is disclosed having first and second elongated, hollow members, each having first and second ends. The first ends of the first and second members are connected at a connection that allows fluid to be communicated from the first member to the second member. The first member has a hose connector at the second end. The second member has a plurality of holes positioned proximate the second end of the second member. An anvil is connected to the second member proximate the first end of the second member, and a piercing tip is connected to the second end of the second member. In use, water passes through interior cavities of the nozzle from the second end of the first member, through the first and second members, and out the holes in the second member.

A piercing hose nozzle is also disclosed having first and second rigid, elongated members connected at a connection. The second member defines a plurality of holes in a sidewall of the second member. The holes are positioned circumferentially around the second member near an end of the second member. A piercing tip is connected to the end of the second member. A hose connection provides fluid to the holes.

An apparatus is also disclosed having first and second rigid, hollow members, each having first and second ends and being connected to each other at the first ends to form a connection that communicates fluid between the first and second members through interior cavities defined therein. The second member has a plurality of holes defined in a sidewall. The holes are distributed around a circumference of the second member and direct fluid out of the interior cavity of the second member outward from a longitudinal axis at the second member. A stop is connected to the second member between the first end and the holes. The stop is formed from a metal plate that is wider than the second member. An anvil is connected at the first end of the second member proximate the connection. The anvil is aligned coaxial with the second member so that a force exerted on the anvil will translate along the longitudinal axis of the second member. A piercing tip is connected to the second end of the second member.

A piercing nozzle that attaches to a hose is also disclosed. The nozzle includes means for piercing a first side of a wall, such as a piercing tip, and a means for dispersing a fluid to a second side of the wall, such as holes positioned in a portion of the nozzle. The nozzle further includes a means connecting to a hose containing the fluid and a means for communicating the fluid from the means for connecting to the means for dispersing, for example, through hollow tubes. The nozzle further includes a means for urging the means for piercing through the wall to the second side after the means for piercing has initially pierced the wall, while the means for piercing is positioned in the wall, such as an anvil that can be hammered after the piercing tip has penetrated partially through the wall. The nozzle also includes a means for limiting distance by which the means for piercing passes through the wall, such as a stop plate.

SUMMARY OF DRAWINGS

The detailed description will refer to the following drawings, wherein like numerals refer to like elements, and wherein.

DETAILED DESCRIPTION

Figure 1:
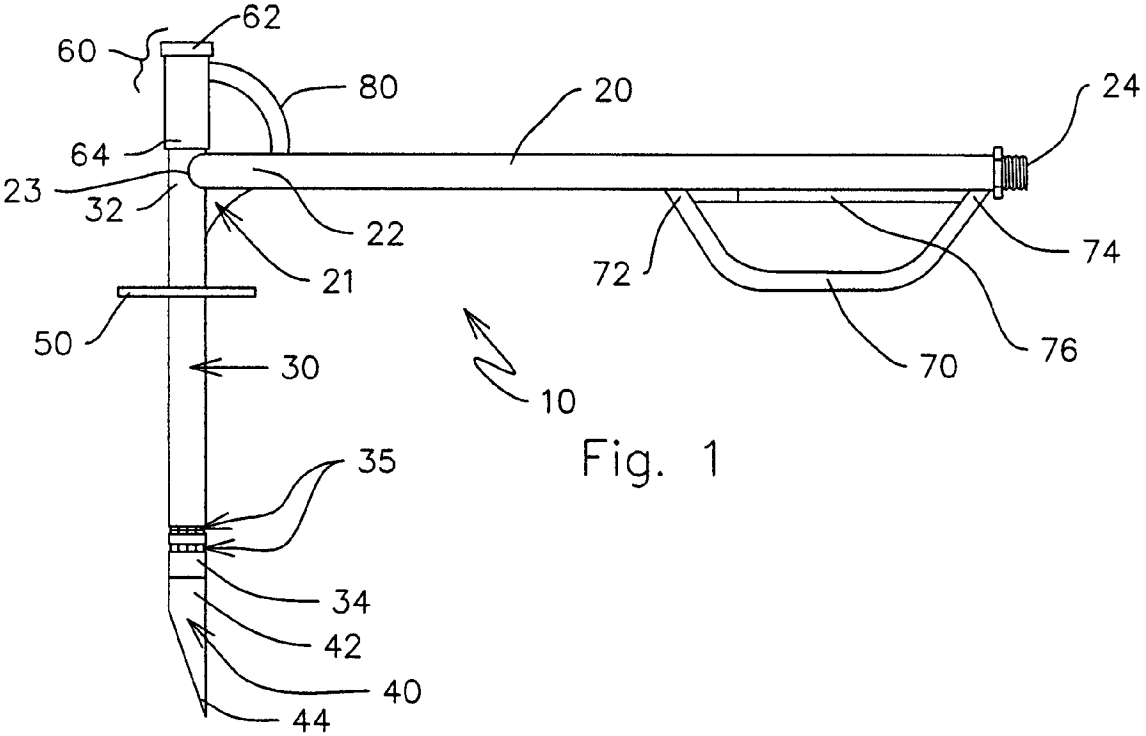
FIG. 1 shows a piercing nozzle having first and second elongated members.

FIG. 1 shows a piercing nozzle 10 having first and second elongated members 20, 30. The first and second elongated members 20, 30 meet each other at a connection 23. In one embodiment, the first and second elongated members 20, 30 are approximately perpendicular to each other at the connection 23. A gusset 21 also connects the first and second elongated members 20, 30 near the connection 23, in the embodiment shown in FIG. 1. The first and second elongated members 20, 30 are hollow, rigid members adapted to hold and transmit a liquid, such as water. In one embodiment, the first and second elongated members 20, 30 are hollow tubes formed from steel and have a diameter of approximately 1.5 inches with a sidewall thickness of approximately 0.12 inches. The first elongated member 20 has a first end 22 that connects to a first end 32 of the second elongated member 30. The connection 23 is also hollow and allows fluid to be communicated through the first elongated member 20, into the second elongated member 30. The first elongated member 20 has a second end 24. In the embodiment shown in FIG. 1, the second end 24 has a hose connector that is adapted to connect to a hose (not shown), such as a fire hose containing water. The hose connector at the second end 24 may include any apparatus that can connect to a hose, such as threads, ball and socket connectors, quick connectors, or any other suitable connector.

The second elongated member 30 has a second end 34 that connects to a piercing tip 40. The piercing tip 40 has a first end 42 that connects to the second end 34 of the second elongated member 30 and a second end 44 that is sharp. In one embodiment, the tip 40 is formed from a hardened steel and detachably connects to the second end 34 of the second elongated member 38. The second end 34 is tapered at an angle of 20 degrees. A plurality of holes 35 are defined in the second elongated member 30 proximate the second end 34. The holes 35 allow water contained within the second elongated member 30 to spray outwardly from the second elongated member 30. The holes 35 are formed in grooves that run around the circumference of the second end 34 of the second elongated member 30. A stop 50 is positioned between the first and second ends 32, 34 of the second elongated member 30. In one embodiment, the stop 50 is a round steel plate that is approximately 6 inches in diameter and approximately 3/16 inch thick. In use, the stop 50 prevents the second elongated member 30 from passing too far into a building or other wall on which the nozzle 10 is being used.

An anvil 60 is connected to the first end 32 of the second elongated member 30. As used herein, an "anvil" refers to any portion of the nozzle 10 adapted to be struck with a hammer or similar heavy object. In use, the anvil 60 may be hammered by the user to urge the second elongated member 30 further into the wall. The anvil 60 in FIG. 1 includes a first end 62 and a second end 64. In this embodiment, the second end 64 attaches to the first end 32 of the second elongated member 30. The first end 62 of the anvil 60 is struck with a hammer or other object in use. In one embodiment, the first end 62 of the anvil 60 is detachable from the second end 64 of the anvil 60. For example, the first end 62 may be threadably connected to the second end 64 of the anvil 60. In the embodiment shown, the second end 64 is a fixed portion. In one embodiment, the anvil 60, or at least the first end 62 thereof, is formed from a hardened steel.

The nozzle 10 also includes a handle 80 extending from the first elongated member 20 to the anvil 60. In one embodiment, the handle 80 is a round steel tube having a ¾ inch outside diameter and a wall thickness of 0.12 inches. In this example, the handle 80 is curved at a radius of approximately 3 inches.

The embodiment of FIG. 1 includes a guard 70. The guard 70 connects to the first elongated member 20 in FIG. 1 at first and second end 72, 74 of the guard 70. The second end 74 of the guard 70 connects to the first elongated member 20 near a second end 24. The guard 70 is a ¾ inch hollow tube having a thickness of approximately 0.12 inches, in one embodiment, and extends approximately one-quarter to one-half of the distance from the second end 24 of the first elongated member 20, and is approximately 14 inches in one particular embodiment. In one embodiment, the handle 70 extends approximately 4 to 5 inches outward from the first elongated member 20. Ends 72, 74 meet the first elongated member 20 at angles of approximately 55 degrees, in one embodiment. A grip 76 is formed from a ½ inch square tube positioned inside the handle 70, running along and parallel to the first elongated member 20.

In use, a user holds the first elongated member 20 of the nozzle 10 with at least one hand near the guard 70 and swings the nozzle 10 like an axe causing the tip 40 to penetrate a wall (not shown) having a fire behind the wall. To urge the tip 40 further into and through the wall, the anvil 60 may be hammered. The tip 40 passes into the wall until the stop 50 hits the outside of the wall, thereby preventing the tip 40 from passing further into the wall. Before or after the nozzle 10 is in place in the wall, a hose (not shown) is connected to the second end 24 of the nozzle 10. The hose is turned on when the nozzle 10 is in position, which causes water to pass through the first and second members 20, 30 and out the holes 35 defined in the second member 30, which are then positioned on the "hot" side of the wall. The nozzle 10 provides water to the fire, while creating a minimal hole in the wall so that only a minimal amount of air enters through the hole in the wall.

Figure 2:
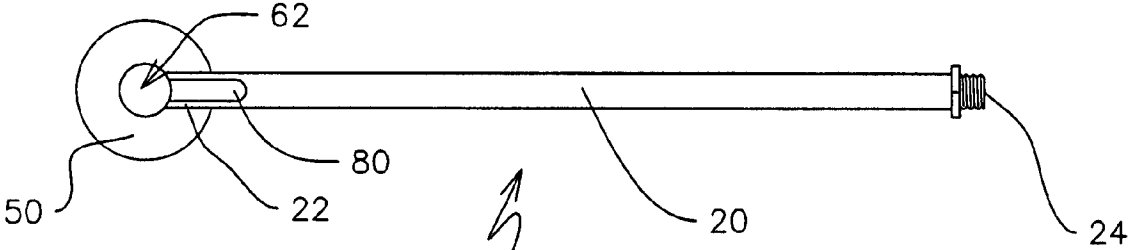
FIG. 2 shows a side view of the nozzle shown in FIG. 1.

FIG. 2 shows a side view of the nozzle 10 shown in FIG. 1. As shown in FIG. 2, the first and second elongated members 20, 30 are generally cylindrical hollow tubes in this embodiment. The first end 62 of the anvil 60 in FIG. 1 is generally aligned with the longitudinal axis of the second elongated member 30. This allows a force exerted by a hammer or other object on the anvil 60 to be translated along the longitudinal axis of the second member 30, thereby urging the second member 30 further into the wall, in use. In the embodiment of FIG. 2, the stop 50 is also a generally round, flat piece of metal. The stop 50 has a diameter substantially larger than the diameter of the second elongated member 30 in FIG. 1.

Figure 3:
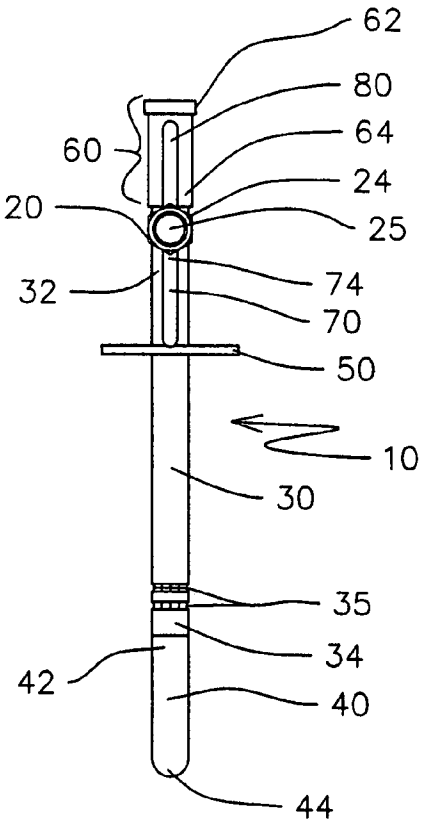
FIG. 3 shows another side view of the nozzle shown in FIGS. 1 and 2.

FIG. 3 shows another side view of the nozzle 10 shown in FIGS. 1 and 2. As shown in FIG. 3, the anvil 60 is generally aligned coaxially with the second elongated member 30, such that when the first portion 62 of the anvil 60 is struck with a hammer or other object, the force is exerted along the longitudinal axis of the second elongated member 30, thereby driving the second elongated member 30 further into a wall or other structure. The first elongated member 20 is a hollow, cylindrical metal tube in the example of FIG. 3. The member 20 defines a cavity 25 through which water or other liquid passes. As shown in FIG. 3, the first and second elongated members 20, 30, the guard 70, the anvil 60, and the handle 80 are generally contained within a plane. As also shown in FIG. 3, the tip 40 is generally cylindrical, coming to a sharpened point at the second end 44 in this embodiment.

Figure 4:
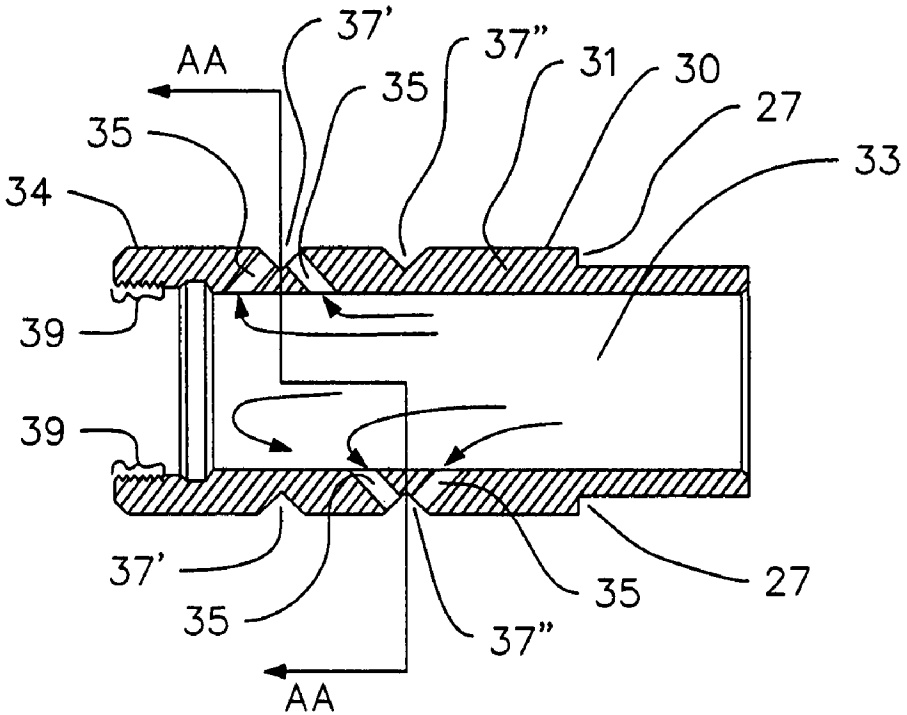
FIG. 4 shows a cross-section of the second end of the second elongated member near the holes shown in FIG. 1.

FIG. 4 shows a cross-section of the second end 34 of the second elongated member 30 near the holes 35 shown in FIG. 1. The second elongated member 30 is generally cylindrical in the example of FIG. 4 and includes a sidewall 31 that defines an interior cavity 33. The cavity 33 contains water or other liquid to be dispersed at a fire. The water travels through the cavity 33 and exits holes 35 in the sidewall 31 of the second elongated member 30. As shown by the arrows in the example of FIG. 4, the tip (40 in FIG. 1) has threads (not shown) that engage threads 39 of the second end 34 of the second elongated member 30. In this example, the tip (40 in FIG. 1) is solid and does not allow water to pass through the second end 34 of the second elongated member 30, as shown by the arrows. This forces all of the water traveling through the cavity 33 out the holes 35 in the sidewalls 31. The holes 35 are positioned generally at 45-degree angles relative to a longitudinal axis of the second elongated member 30. The holes 35 are positioned in grooves 37 that wrap around the circumference of the second elongated member 30. Holes 35 are spaced at intervals along the circumference of the second elongated member 30, within the grooves 37. In the example shown in FIG. 4, the holes 35 are offset such that there are not holes 35 within the same groove 37 on the opposite side of the cavity 33, for example, directly above or below the holes 35 shown in FIG. 4. As also shown, the holes 35 in adjacent grooves 37 are offset from each other so that holes 35 are not directly next to each other in different grooves 37. Other embodiments have more or fewer grooves (e.g., 37) and/or holes (e.g., 35).

In the embodiment of FIG. 4, the portion of the second elongated member 30 shown in FIG. 4 is formed separate from the remainder of the second elongated member 30. Notched portions 27 are used to connect the portion of the second elongated member 30 shown in FIG. 4 with the remainder of the second elongated member 30. In other embodiments, the entire second elongated member 30 may be formed from a single piece of tubing material.

Figure 5:
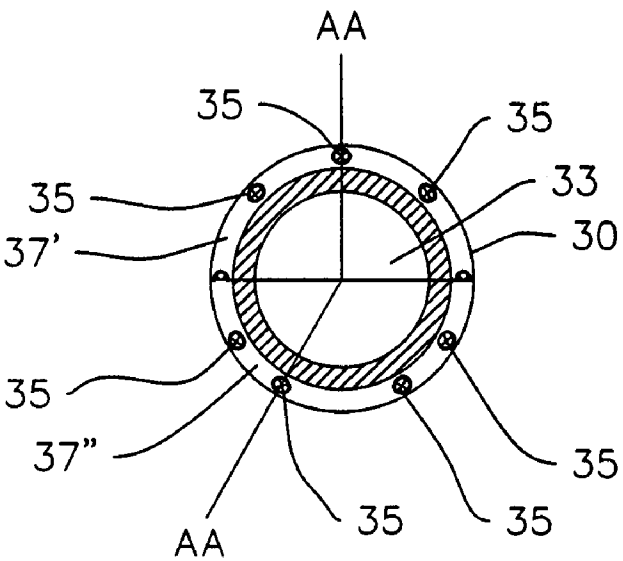
FIG. 5 shows a cross-section of the second elongated member, taken along the line AA—AA shown in FIG. 4.

FIG. 5 shows a cross-section of the second elongated member 30, taken along the line AA—AA shown in FIG. 4. As shown in FIG. 5, the top half of the cross-section is taken generally from a first groove 37', while the bottom half of the cross-section is taken from a second groove 37". The holes 35 are generally dispersed around the circumference of the groove 37 running around the second elongated member 30 and being formed the sidewall 31 of the second elongated member 30. Holes 35 in a first groove 37, such as the top groove 37' are offset from holes 35 in an adjacent groove 37, such as the bottom groove 37" shown in FIG. 5, in this example.

Figure 6:
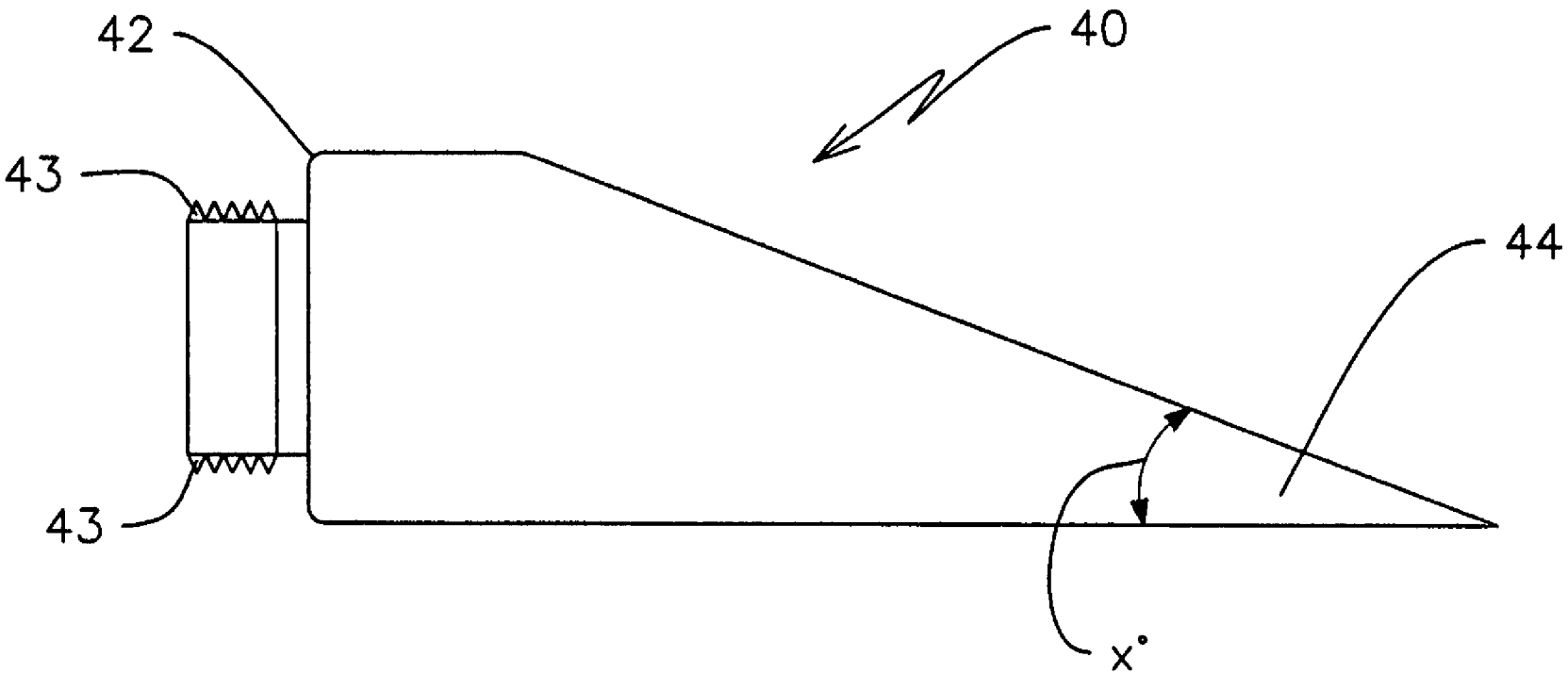
FIG. 6 shows a side view of the tip.

FIG. 6 shows a side view of the tip 40. In the example of FIG. 6, the tip 40 is formed from a hardened steel and detachably connects to the second end 34 of the second elongated member 30 via threads 43 that engage threads (39 in FIG. 4) of the second elongated member 30. The tip 40 has a first end 42 that abuts the second end 34 of the second elongated member 30. The tip 40 also has a second end 44 that is tapered to form a sharpened end 44. In the example of FIG. 6, the second end 44 is tapered at an angle, X-degrees. In one embodiment, the angle X degrees is in the range of 10 to 30 degrees. In one specific embodiment, the angle X degrees is 20 degrees.

Figure 7:
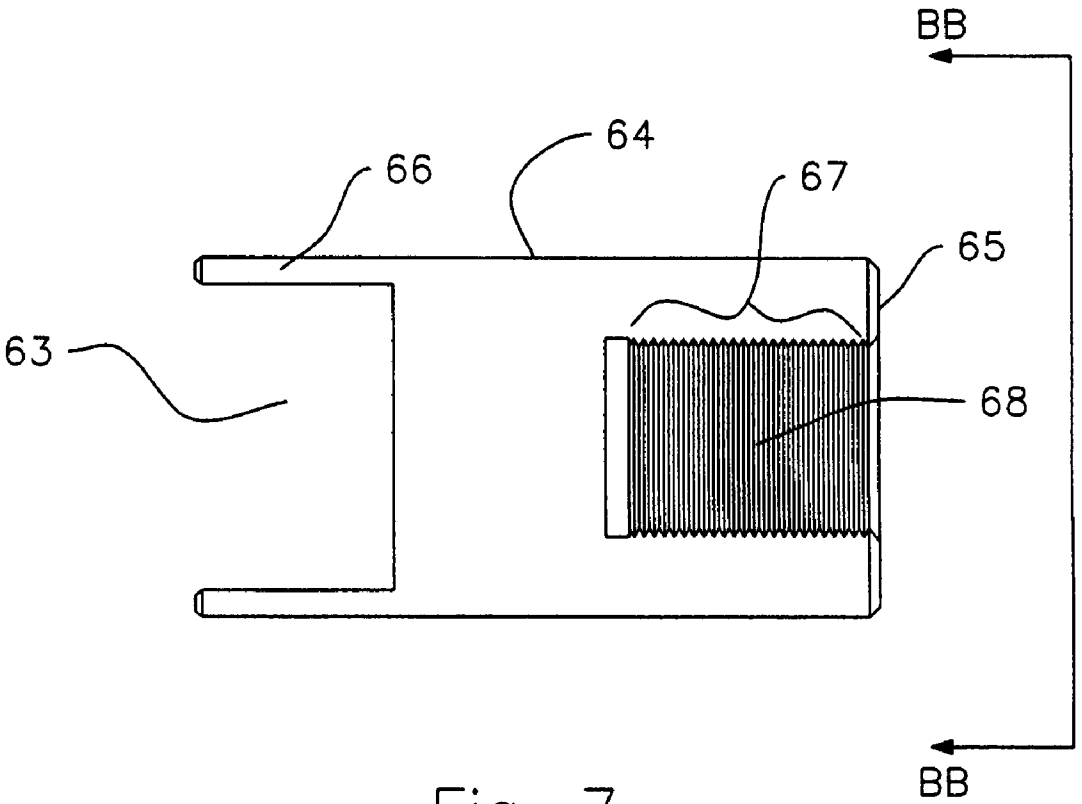
FIG. 7 shows a side view of the fixed portion of the anvil shown in FIG. 1.

FIG. 7 shows a side view of the second end (also referred to herein for this embodiment as the "fixed portion 64") of the anvil 60 shown in FIG. 1. The fixed portion 64 has a first end 65 having a generally flat surface and a second end 66. In the example of FIG. 7, the second end 66 includes a cylindrical cavity 63 that encircles the first end 32 of the cylindrical second elongated member 30. In one embodiment, the fixed portion 64 of the anvil 60 is welded or otherwise affixed to the first end 32 of the second elongated member 30. The first end 65 has a cylindrical cavity 68 defined therein. The cavity 68 has threads 67 and receives a first portion (62 in FIG. 1) of the anvil (60 in FIG. 1), which detachably connects to the fixed portion 64 of the anvil 60.

Figure 8:
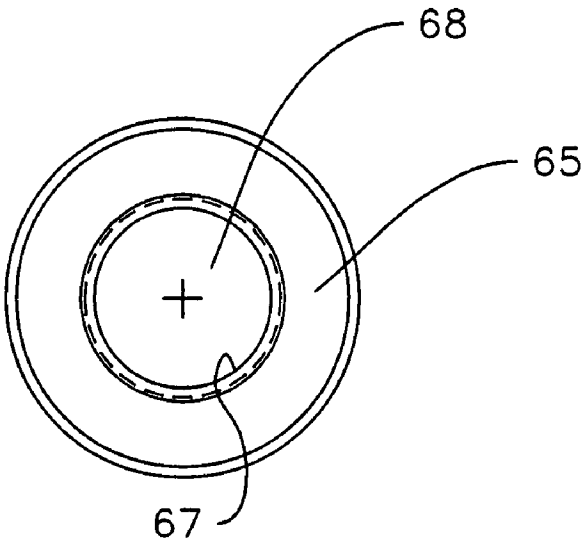
FIG. 8 shows a side view of the first end of the fixed portion of the anvil.

FIG. 8 shows a side view of the first end 65 of the fixed portion 64 of the anvil 60. As shown in FIG. 8, the fixed portion 64 of the anvil 60 is generally circular and has defined therein a threaded cavity 68 that is generally circular, which receives a first portion of the anvil 60 that detachably connects to the fixed portion 64.

Figure 9:
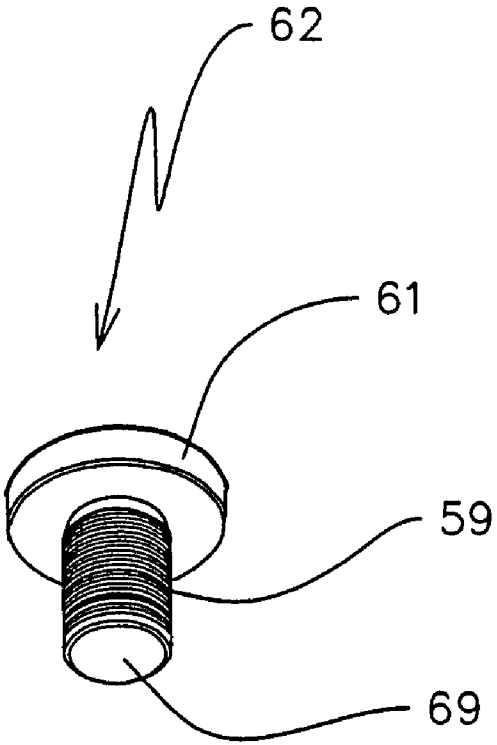
FIG. 9 shows a perspective view of a first portion of the anvil.

FIG. 9 shows a perspective view of a first portion 62 of the anvil (60 in FIG. 1). The first portion 62 includes a first end 61 and a second end 69. The first end 61 is wider than the second end 69 in this embodiment. The first end 61 is generally circular and has approximately the same diameter as the fixed portion 64 of the anvil 60 in this example. The threads 59 of the first portion 62 of the anvil 60 engage threads (67 in FIG. 7) of the threaded cavity (68 in FIG. 7).

Figure 10:
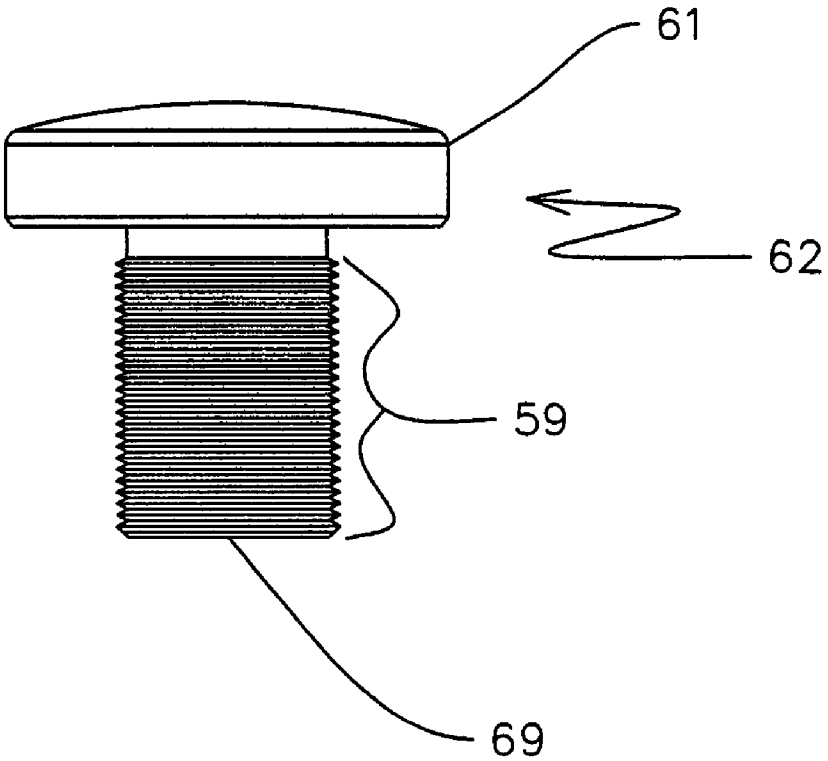
FIG. 10 shows a side view of the first portion of the anvil shown in FIG. 9.

FIG. 10 shows a side view of the first portion of the anvil 60 shown in FIG. 9. The first end 61 of the first portion 62 of the anvil 60 is generally wider than the second end 69 of the first portion 62. In use, the first portion 62 of the anvil (60 in FIG. 10) detachably connects to the fixed portion 64 of the anvil 60 via the threads 59. This allows the first portion 62 of the anvil 60 to be removed and/or replaced as needed. In use with the nozzle (10 in FIG. 1), the first portion 62 of the anvil 60 is struck with a hammer or similar object to urge the second elongated member 30 into a wall or other structure.

Figure 11:
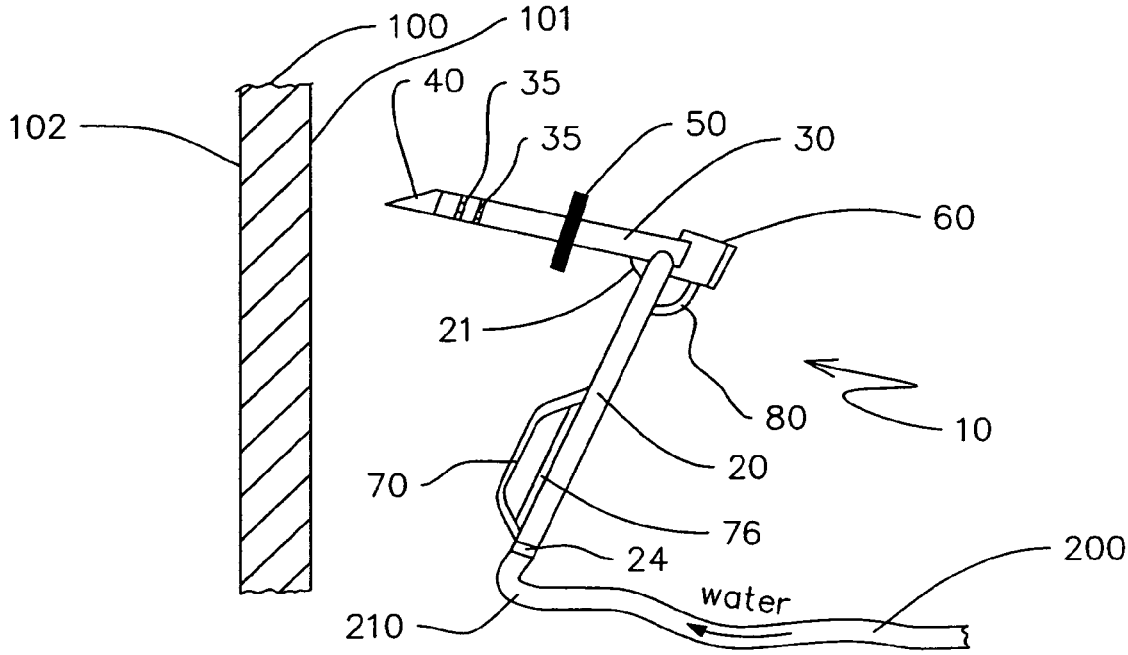
FIG. 11 shows the nozzle in use with a wall.

FIG. 11 shows the nozzle 10 in use with a wall 100. The first elongated member 20 is connected to a hose 200 that carries water, such as a fire hose. And end 210 of the hose 200 attaches to the second end 24 of the first elongated member 20 to communicate water from the hose 200 to the nozzle 10. When the water is turned on and is flowing through the hose 200, the water passes through the first and second elongated members 20, 30 and sprays out the holes 35 in a direction generally normal to a longitudinal axis of the second elongated member 30. The nozzle 10 may be used by firefighters or other individuals in connection with extinguishing a fire inside a wall of a structure. In FIG. 11, a cross-section of a wall 100 is shown. The wall 100 has a first side 101 and a second side 102. In this example, the first side 101 may be an exterior side of the wall 100, and the second side 102 is an interior side. The nozzle 10 may be used to extinguish a fire inside the wall 100—that is, on the interior side 102 of the wall. The nozzle 10 is swung by the user like an axe, as shown by the arrow in FIG. 11. The piercing tip 40 of the nozzle 10 pierces the wall 100. Once the nozzle 10 is extended into the wall 100, the water supply running through the hose 200 may be turned on, causing water to spray out the holes 35, on the opposing side of the wall 102. If the user has difficulty penetrating the wall 100 by swinging the nozzle 10, the user may pound the anvil 60 of the nozzle 10 with a hammer or other heavy object to penetrate the wall 100.

Figure 12:
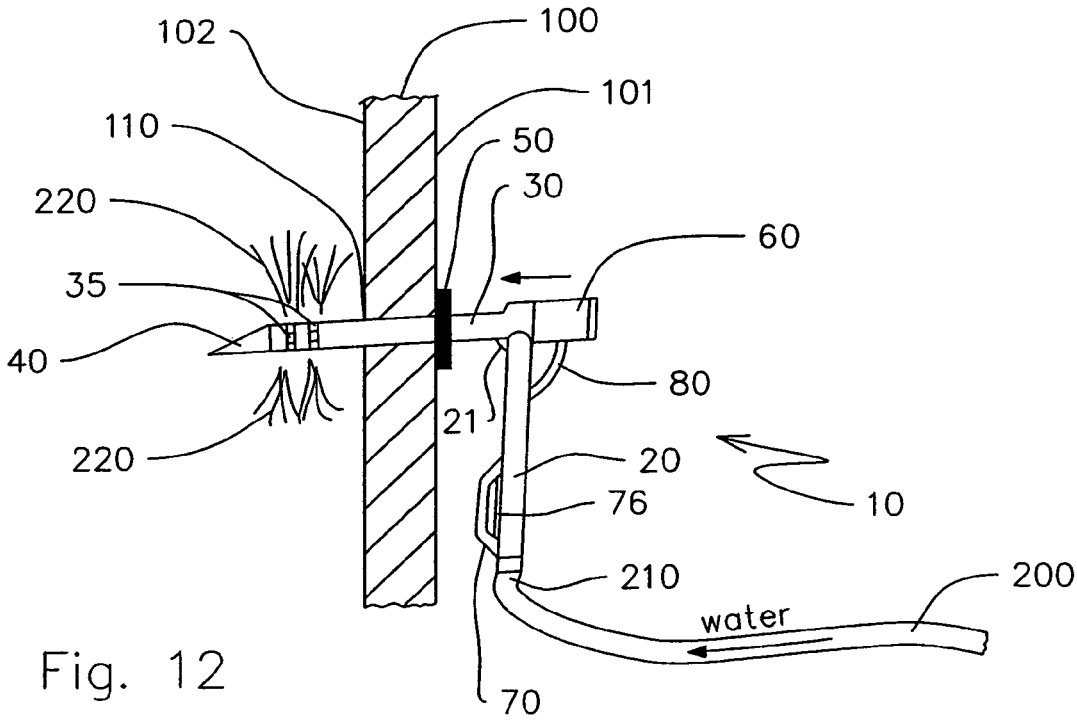
FIG. 12 shows a cross-section of the wall shown in FIG. 11, after the nozzle has penetrated through the wall from the first side to a second side.

FIG. 12 shows a cross-section of the wall 100 shown in FIG. 11, after the nozzle 10 has penetrated through the wall 100 from the first side 101 to a second side 102. The second elongated member 30 penetrates through a hole 110 in the wall 100 until the stop 50 hits the outside 101 of the wall 100. The stop 50 prevents the nozzle 10 from penetrating too far into the wall 100. The stop 50 also minimizes the amount of air that is allowed to pass through the hole 110 from the first side 101 to the second side 102 of the wall 100. After the nozzle 10 is in position through the wall 100, water 220 is turned on to the hose 200. The water 220 passes through the interior cavities 25, 33 of the first and second elongated members 20, 30 respectively, and sprays outwardly from the second end 34 of the second elongated member 30 into an area on the second side 102 of the wall 100. This allows the nozzle 10 to penetrate a wall 100 and extinguish a fire on an opposite side of the wall 100 without completely cutting a large hole in the wall, and thereby allowing oxygen from the first side of the wall 101 to enter to the second side of the wall 102 where the fire is.

Figure 13:
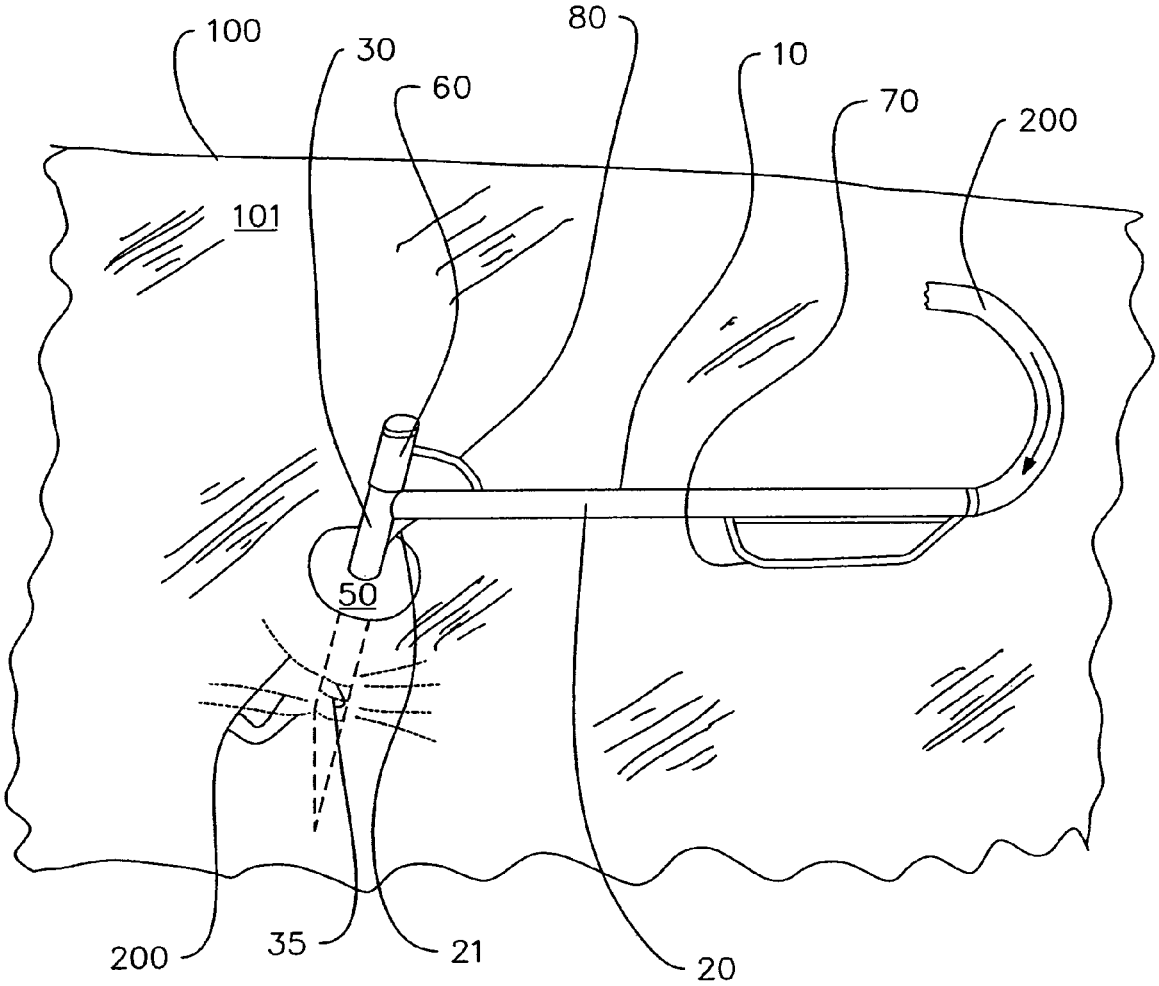
FIG. 13 shows a first side of the wall shown in FIGS. 11 and 12.

FIG. 13 shows a first side 101 of the wall 100 shown in FIGS. 11 and 12. In the example of FIG. 13, the nozzle 10 has penetrated the wall 100 through the first side 101. The stop 50 is abutted against the first side 101 of the wall 100. The second elongated member 30 has penetrated the wall 100 up to the stop 50. Water is shown being sprayed sideways from the holes 35 on an opposing side (102 in FIGS. 11 and 12) of the wall 100.

Although the present invention has been described with respect to particular embodiments thereof, variations are possible. The present invention may be embodied in specific forms without departing from the essential spirit or attributes thereof. In particular, although certain connections are described as having threads, one skilled in the art will recognize that any suitable connection may be used. Also, although the invention is described with respect to embodiments in which fluid passes through an interior cavity of the apparatus, running through substantially the entire length of the apparatus, one skilled in the art will recognize that other embodiments may connect to a hose at a different point, and the fluid may pass through an interior cavity in only a part of the apparatus, or may communicate fluid to the holes without passing the fluid through any interior cavity. Although the elongated members are shown as being hollow in the embodiments described herein, other embodiments may use solid materials and use a different means of communicating the fluid to the holes. For example, one alternative embodiment connects to a hose near the first end or the second member, in place of or adjacent to the anvil (60 in FIG. 1). It is desired that the embodiments described herein be considered in all respects illustrative and not restrictive and that reference be made to the appended claims and their equivalents for determining the scope of the invention.

What is claimed is:

1. A piercing nozzle comprising:

a first elongated, hollow member having first and second ends, the second end comprising a hose connector;

a second elongated, hollow member having first and second ends, wherein the first end of the second member is connected to the first end of the first member at a connection that allows fluid to be communicated from the first member to the second member, and wherein the second member defines a plurality of holes proximate the second end of the second member, wherein the second member is shorter than the first member;

a hand guard connected to the first member, extending outward from the first member at a distance, wherein the hand guard comprises an elongated portion that extends generally parallel to the first member;

a stop plate connected to the second member, wherein the stop plate has a diameter greater than the second member, and wherein the stop plate is generally parallel to the first member and is spaced from the first member by substantially the same distance as the hand guard;

an anvil connected to the second member proximate the first end of the second member; and a piercing tip connected to the second end of the second member.

2. The nozzle of claim 1, wherein the second member is connected to the first member at a 90-degree angle.

3. The nozzle of claim 1, wherein the first and second members are formed from 1.5-inch diameter steel tubing.

4. The nozzle of claim 3, wherein the tubing is 0.120 inches thick.

5. The nozzle of claim 1, wherein the anvil portion and the tip are formed from hardened steel.

6. The nozzle of claim 1, wherein the first elongated member has a length in the range of 24–48 inches, and wherein the second elongated member has a length in the range of 18–36 inches.

7. The nozzle of claim 1, wherein the first elongated member is 36 inches in length.

8. The nozzle of claim 1, wherein the anvil comprises a fixed portion that is fixedly connected to the first end of the second member and a striking portion that removably connects to the fixed portion of the anvil, and wherein the fixed portion of the anvil and the striking portion are formed from hardened steel and are coaxial with the second elongated member.

9. The nozzle of claim 1, wherein the tip has a sharpened end that forms an angle in the range of 10–30 degrees.

10. The nozzle of claim 1, wherein the tip has a sharpened end that forms a 20-degree angle.

11. The nozzle of claim 1, wherein the holes are formed in a sidewall of the second elongated member and direct water outward from a longitudinal axis of the second elongated member.

12. The nozzle of claim 11, wherein the holes are formed in a groove running around a circumference of the second elongated member.

13. The nozzle of claim 12, wherein the holes are spaced within the groove in pairs, wherein each of the holes is set at an angle relative to a longitudinal axis of the second elongated member such that a first hole in one of the pairs directs water toward water exiting a second hole in one of the pairs.

14. The nozzle of claim 12, wherein the holes are spaced within the groove in pairs and are aligned at 45-degree angles relative to a longitudinal axis of the second elongated member.

15. The nozzle of claim 1, wherein the holes are formed in a plurality of grooves running around the second elongated member, wherein the holes in a first groove are offset relative to holes in an adjacent second groove.

16. The nozzle of claim 1, further comprising a handle connected to the first elongated member and to the anvil.

17. The nozzle of claim 1, wherein the hand guard has first and second ends each connected to the first member, and wherein the hand guard and the first member define a plane.

18. The nozzle of claim 17, further comprising a ridge connected to the first member, wherein the ridge runs along the first member between the first and second ends of the hand guard, within the plane, and serves as a hand grip.

19. A piercing nozzle comprising:

a first elongated, hollow member having first and second ends, the second end comprising a hose connector;

a hand guard connected to the first member, wherein the hand guard comprises a portion that extends outward from the first member by a distance;

a second elongated, hollow member having first and second ends, wherein the first end of the second member is connected to the first end of the first member at a connection that allows fluid to be communicated from the first member to the second member, and wherein the second member defines a plurality of holes proximate the second end of the second member;

a stop connected to the second member and spaced from the first member by substantially the same distance by which the portion of the hand guard is spaced from the first member;

an anvil connected to the second member proximate the first end of the second member; and a piercing tip connected to the second end of the second member.

20. The nozzle of claim 19, further comprising a means for allowing the first member to be gripped by a person's hand, said means being guarded by the hand guard.

21. The nozzle of claim 19, wherein the hand guard has first and second ends each connected to the first member, and wherein the hand guard and the first member define a plane, and further comprising a ridge connected to the first member, wherein the ridge runs along the first member between the first and second ends of the hand guard, within the plane, and serves as a hand grip.

22. The nozzle of claim 19, wherein the stop is a metal plate that is wider than the second elongated member and is connected to the second elongated member between the first and second ends.

23. The nozzle of claim 19, wherein the stop is connected to the second member at a distance of 12–20 inches from a sharpened end of the piercing tip.

24. A piercing hose nozzle comprising:

first and second rigid, elongated members connected at a connection, wherein the first member is longer than the second member, wherein the second member defines a plurality of holes in a sidewall of the second member, wherein the holes are positioned circumferentially around the second member near an end of the second member;

a hand guard connected to the first member and including a portion extending outward from the first member by a distance;

a stop being spaced from the first member by substantially the same distance as the portion of the hand guard, wherein the stop is adapted to limit penetration by the second member through a surface;

a piercing tip connected to the end of the second member; and a hose connection that provides fluid to the holes.

25. The nozzle of claim 24, further comprising an anvil connected to the second member.

26. The nozzle of claim 24, wherein the hose connection is positioned at an end of the first member and wherein the first and second members are hollow and communicate fluid through an interior cavity from the hose connection to the holes.

27. The nozzle of claim 24, wherein the second member is cylindrical.

28. An axe-style firefighting apparatus comprising:

a first rigid, elongated, hollow member comprising a hose connection adapted to connect to a hose;

a grip capable of facilitating a person's grasp of the first member; and a hand guard positioned proximate the grip, the hand guard including a portion extending outward from the first member by a distance; and a second rigid, elongated, hollow member, wherein the second member is shorter in length than the first member, wherein the second member is connected to the first member at a substantially perpendicular connection that allows communications of fluid between the first member and the second member, wherein the second member comprises a piercing tip, and wherein the second member defines a plurality of holes proximate the piercing tip that allow fluid to escape the second member, and wherein the second member comprises a stop positioned at a distance relative to the first member that is substantially the same as the distance of the portion of the hand guard relative to the first member.

29. The apparatus of claim 28, wherein the grip comprises a ridge running along the first member between first and second ends of the hand guard.

30. The nozzle of claim 28, wherein the stop has a diameter of approximately six inches.

* * * * *